US005210911A

United States Patent [19]

Brown et al.

[11] Patent Number: 5,210,911

[45] Date of Patent: May 18, 1993

[54] WRAPPING DEVICE

[75] Inventors: Douglas T. Brown; David D. Brown, both of East Brunswick; Virginia M. Brown, Irvington, all of N.J.

[73] Assignee: Zel Products Inc., East Brunswick, N.J.

[21] Appl. No.: 918,629

[22] Filed: Jul. 21, 1992

[51] Int. Cl.[5] ..... B65D 63/16

[52] U.S. Cl. ..... 24/18; 24/129 B

[58] Field of Search ..... 24/16 R, 17 R, 18, 129 R, 24/129 B, 130, 28

[56] References Cited

U.S. PATENT DOCUMENTS

| | | | |
|---|---|---|---|
| 757,820 | 4/1904 | Lykke | 24/130 |
| 1,161,297 | 11/1915 | Faust | 24/18 |
| 1,213,479 | 1/1917 | Harriman | 24/18 |
| 1,806,162 | 5/1931 | Hahn | 24/18 |
| 3,675,276 | 7/1972 | Nuse | 24/129 B X |
| 4,939,820 | 7/1990 | Babcock | 24/129 B X |

FOREIGN PATENT DOCUMENTS

| | | | |
|---|---|---|---|
| 592551 | 10/1977 | Switzerland | 24/18 |

*Primary Examiner*—James R. Brittain
*Attorney, Agent, or Firm*—Arthur L. Lessler

[57] ABSTRACT

A device for rapidly wrapping a bundle of newspapers or magazines to be recycled, consisting of a fiberboard plate having a hole with a string-receiving slit through its major surfaces, and arcuate recesses on opposite edges of the plate, each recess having a string-receiving slit. A string is looped through the hole and around an adjacent edge of the plate, and tied near one end of the string. To wrap the bundle, the other end of the string is passed around the bundle and through the hole, wedged into the corresponding slit, and then passed by each arcuate recess and wedged into each of the corresponding slits.

4 Claims, 2 Drawing Sheets

WRAPPING DEVICE

BACKGROUND OF THE INVENTION

This invention relates to a device for wrapping articles; and is especially suitable for, but not limited to, wrapping newspapers or magazines to be recycled.

SUMMARY OF THE INVENTION

As herein described there is provided a wrapping device comprising a plate having a hole through its major surfaces. A first string-receiving slit communicates with the hole, while second and third string-receiving slits communicate with two opposed edges of the plate. A string has one end secured to the plate. The widths of the slits are less than the diameter of the string, so that portions of the string remote from the end secured to the plate may be secured to the plate by wedging those string portions into corresponding slits.

IN THE DRAWING

FIG. 1*a* a top plan view of a preferred embodiment of the plate used in the wrapping device of the present invention;

FIG. 1*b* is a right side elevation view of said plate;

FIG. 2 is a top plan view of a preferred embodiment of the wrapping device of the present invention; and FIG. 3 is an isometric view of the wrapping device of the present invention wrapped around a bundle of newspapers or magazines.

DETAILED DESCRIPTION

Figure 1A:
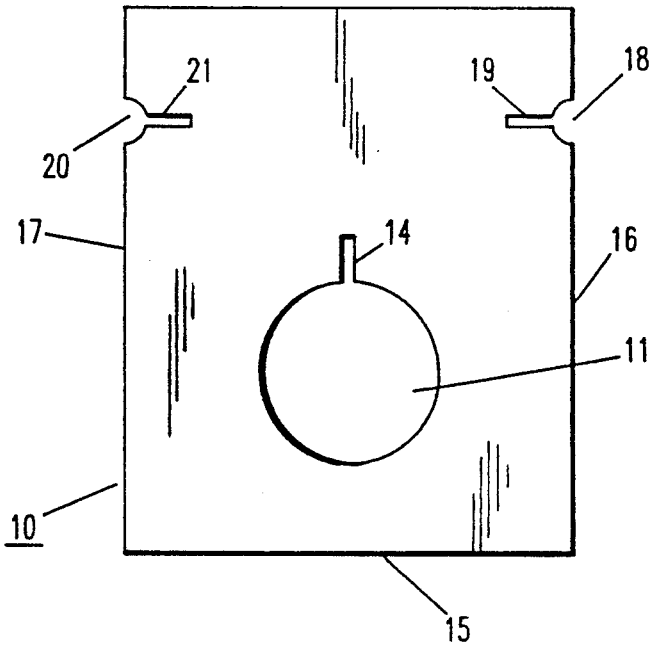
Figure 1B:
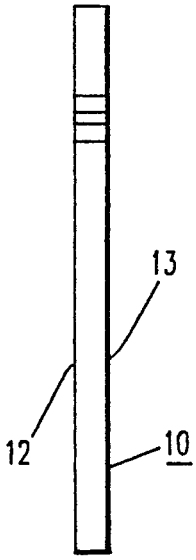

The plate 10 shown in FIG. 1 has a circular hole 11 through its major surfaces 12 and 13, with an elongated slit 14 communicating with the hole 11.

A first edge 15 of the plate 10 is disposed adjacent the hole 11, while second and third parallel edges 16 and 17 are disposed on opposite sides of the hole 11.

The second edge 16 has a funnel-like arcuate recess 18 communicating with said edge, to guide a string portion to be secured into the elongated slit 19 which communicates with the recess 18.

Similarly, the third edge 17 has a funnel-like arcuate recess 20 communicating with said edge, to guide a string portion to be secured into the elongated slit 21 which communicates with the recess 20. The slit 21 is preferably collinear with the slit 19.

The plate 10 is preferably made of a substantially rigid biodegradable material compatible with recycling of paper, such as fiberboard. A suitable material is V2S fiber cardboard which is obtainable from Cardinal Packaging, located at 133 Nathan Road, North Brunswick, N.J. 08902. The preferred thickness of the plate 10 is 3/32 inch.

In the preferred embodiment the plate 10 is rectangular, with the edge 15 being 2½ inches long and the edges 16 and 17 being 3 inches long; the hole 11 being about 1 inch in diameter; the recesses 18 and 20 having a diameter of inch; and each of the slits, 14, 19 and 21 having a width of 1/32 inch and a length of ¼ inch. The plate 10 is preferably manufactured by die stamping.

Figure 2:
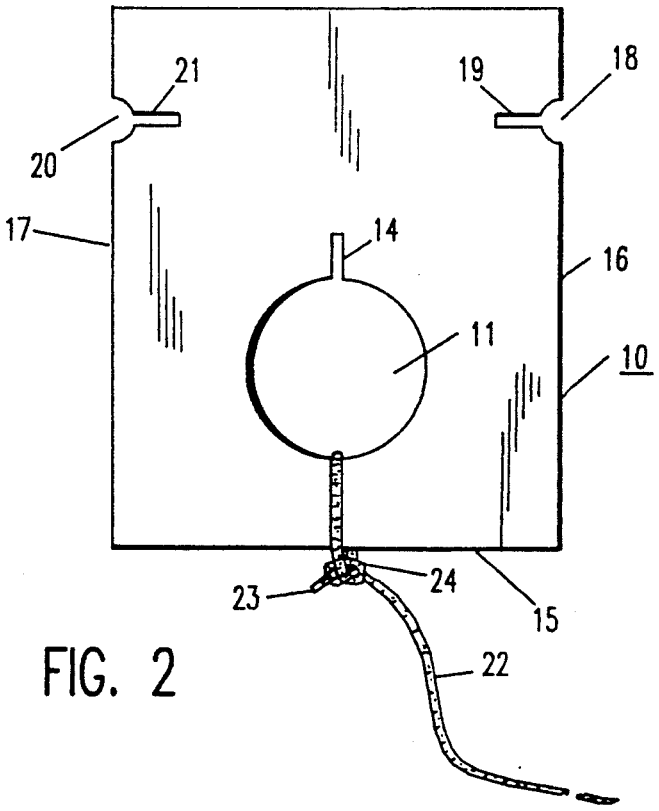

As shown in FIG. 2, a string 22 has one end 23 secured to the plate 10 by being tied around adjacent portions of the inside edge of the hole 11 and the plate edge 15, with a knot 24 being tied in the string 22 adjacent the edge 15.

The string 22 is preferably made of a biodegradable material compatible with recycling of paper, such as cotton. In the preferred embodiment the string 22 is a loosely twisted 24 ply cotton string having a diameter of about ⅛ inch and a length of 4½ feet. The string 22 is deformable so that portions of it may be tightly wedged into the slits 14, 19 and 21.

Figure 3:
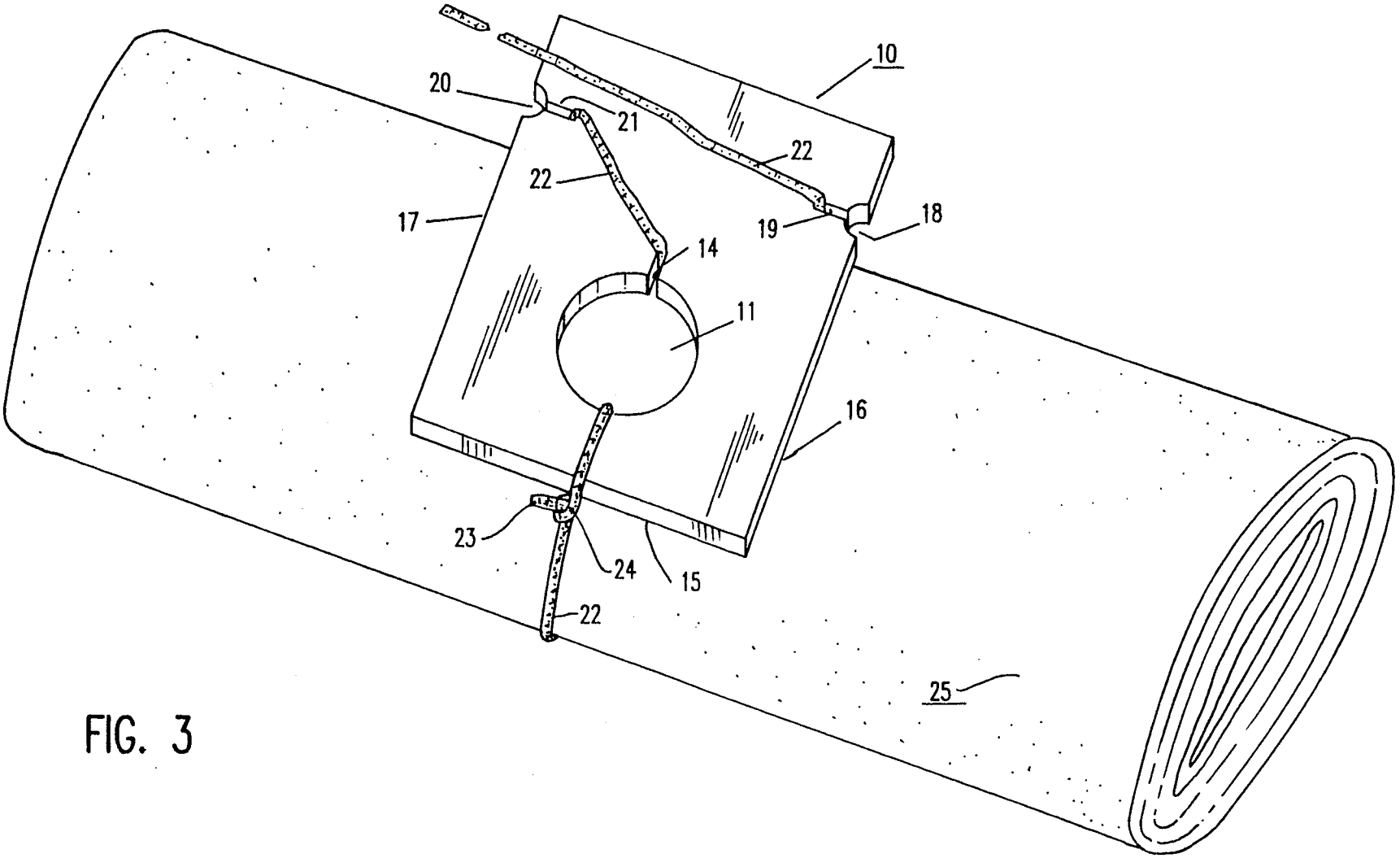

As shown in FIG. 3, to wrap a bundle 25 of newspapers and/or magazines, the plate 10 is placed on the bundle and the free end of the string 22 is passed around the bundle and up through the hole 11, the adjacent portion of the string being pulled tightly so as to wedge it into the slit 14; the string being guided into the slit 14 by the arcuate configuration of the adjacent portion of the hole 11.

The remaining free part of the string 22 is then passed over the surface of the plate 10 and into the recess 20, the adjacent portion of the string being pulled tightly so as to wedge it into the slit 21; the string being guided into the slit 21 by the funnel-like arcuate configuration of the recess 20.

Then the remaining free part of the string 22 is passed under the plate 10 and into the recess 18, the adjacent portion of the string being pulled tightly so as to wedge it into the slit 19; the string being guided into the slit 19 by the funnel-like arcuate configuration of the recess 18.

With the wrapping device herein described, the bundle 25 is rapidly and easily wrapped; and thus secured, it may be conveniently handled and disposed of.

We claim:

1. A wrapping device, comprising:

a plate having opposed major surfaces, a hole through said major surfaces, a first edge adjacent said hole, and second and third opposed edges, said second and third edges being approximately perpendicular to said first edge, said second and third edges each having a funnel-like string-guiding recess therein, first, second and third string-receiving slits communicating with respective ones of said hole and said recesses, said second and third slits being substantially collinear and approximately perpendicular to said first string-receiving slit, said string-receiving slits being arranged in a generally triangular configuration with respect to each other; and string means having one end secured to said plate adjacent said first edge and said hole, the widths of said slits being less than the diameter of said string, said that portions of said string remote from said one end thereof may be secured to said plate by wedging said portions into said slits.

2. The wrapping device according to claim 1, wherein said funnel-like string-guiding recesses are arcuate.

3. The wrapping device according to claim 1, wherein said one end of said string extends through said hole and around said first edge, with a knot in said string securing said string to said plate thereat.

4. A wrapping device, comprising:

a plate having opposed major surfaces, a hole through said major surfaces, a first edge adjacent said hole, and second and third opposed edges, said second and third edges each having a funnel-like string-guiding recess therein, first, second and third string-receiving slits communicating with respective ones of said hole and said recesses, said second and third slits being substantially collinear and approximately perpendicular to said first string-receiving slit, the diameter of said hole being substantially greater than the length of said first slit, said string-receiving slits being arranged in a generally triangular configuration with respect to each other; and string means having one end secured to said plate adjacent said first edge and said hole, the widths of said slits being less than the diameter of said string, so that portions of said string remote from said one end thereof may be secured to said plate by wedging said portions into slits.

* * * * *